United States Patent [19]

Somers

[11] Patent Number: 4,986,205

[45] Date of Patent: Jan. 22, 1991

[54] SELF-FLAKING SAIL SYSTEM

[76] Inventor: John E. Somers, 35776 Koenig, New Baltimore, Mich. 48047

[21] Appl. No.: 376,316

[22] Filed: Jul. 6, 1989

[51] Int. Cl.[5] ..... B63H 9/06

[52] U.S. Cl. ..... 114/104; 114/103

[58] Field of Search ..... 114/102, 103, 104, 105, 114/108, 109, 111; 160/84.1–84.3; 59/86

[56] References Cited

U.S. PATENT DOCUMENTS 4,864,952 9/1989 Stevenson, IV ..... 114/104 X

OTHER PUBLICATIONS

Page 72 of the 1988 Schaefer Marine Catalog, received in PTO on 10–15–87.

*Primary Examiner*—Joseph F. Peters, Jr.
*Assistant Examiner*—Edwin L. Swinehart
*Attorney, Agent, or Firm*—Brooks & Kushman

[57] ABSTRACT

A self-flaking sail system is disclosed, including generally U-shaped shackles, each of which has a pair of legs joined by a bight portion, and having on their opposite ends, transversely aligned retainer receiving apertures, with a retainer pin extending through and locked therein for securing the shackles to the marginal luff edge of a sail. The aperture is situated in a plane which intersects the bight portion at an angle, and such angle causes the sail to flake either one way or the other, depending upon whether a right or left handed shackle is provided.

13 Claims, 4 Drawing Sheets

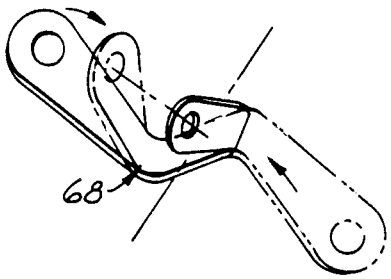
FIG.8
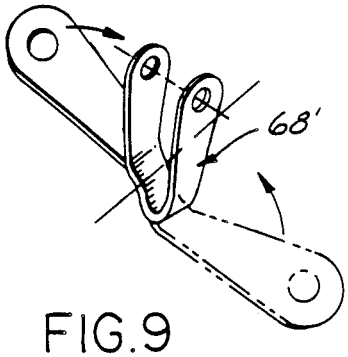
FIG.9
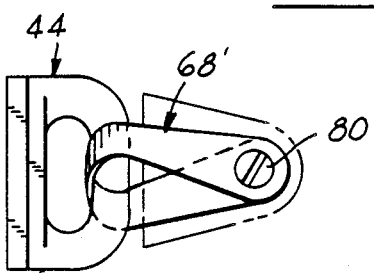
FIG.10
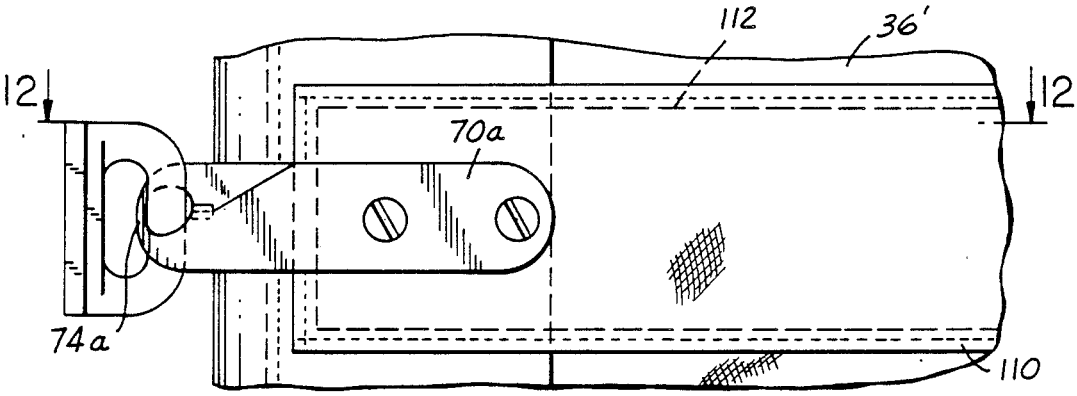
FIG.11
FIG.12
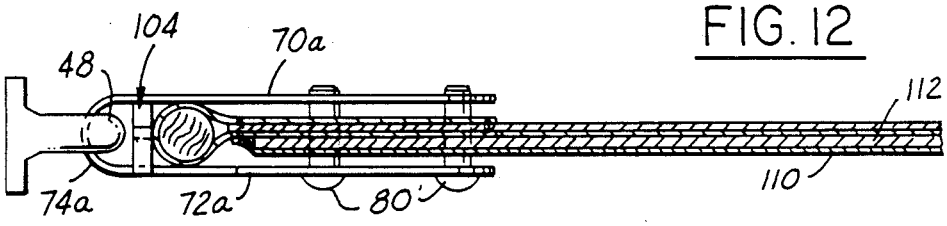
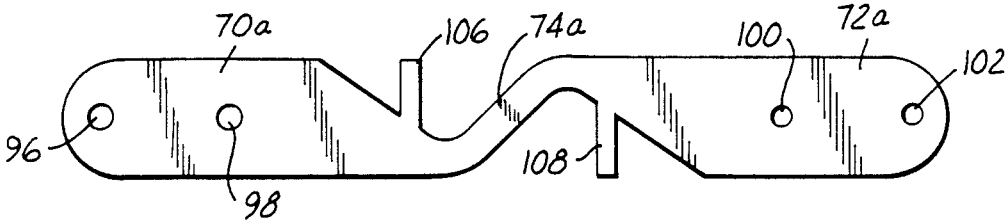
FIG.13

SELF-FLAKING SAIL SYSTEM

TECHNICAL FIELD

This invention relates to a system for causing the sail on a sailboat to automatically flake, first one way and then the other, as the sail is lowered.

BACKGROUND OF THE INVENTION

There has been a need for some time for a system which is simple and foolproof that will automatically flake a sail, first one way and then the other as it is lowered down its track. Such flaking facilitates furling of the sail and particularly on cruising sailboats, which may be short-handed, the automatic flaking and consequent ease of furling and reefing is a decided advantage. As far as I am aware no satisfactory, simple solution has been developed though one approach is shown in U.S. Pat. No 4,688,506.

SUMMARY OF THE INVENTION

My invention causes controlled flaking of the sail as it is lowered and includes means for connecting the sail luff at space-apart points to the sail track for both sliding movement along the track and rotation between positions in which the luff parallels the track or is arranged perpendicular thereto as occurs during flaking of a sail. Means are provided for limiting rotation of the sail luff at said spaced points and is arranged to prevent rotation first in one direction and then the other whereby on lowering the sail, the luff is caused to flake first one way and then the other along the track. The sail is connected to the track by sail slides and companion sail shackles having looped together generally U-shaped portions. At least one U-shaped portion lies in a plane inclined to the direction of said slide movement during sail raising and lowering and the U-shaped portions of the sail slide and shackle are dimensionally sized in relation to the angle of the incline to permit limited rotation between the slide and shackle from a position in which the sail luff is parallel to the sail track and a position in which the sail luff is substantially perpendicular to the sail track. Successive sail slides and sail shackles cause the luff to flake first one way and then the other.

In one embodiment the sail shackle has an inclined bight portion to cause the controlled flaking, while in another embodiment the sail slide has an inclined bail to cause the controlled flaking. The invention is particularly useful also with fullbatten sails.

BRIEF DESCRIPTION OF THE DRAWINGS

FIG. 8 illustrates how a flat shackle stamping is folded into its generally U-shape and which will cause a sail to flake in one direction;

FIG. 9 is similar to FIG. 8 but shows a sail shackle which has been oppositely folded to cause a sail to flake in the opposite direction from that of FIG. 8;

FIG. 10 shows the shackle of FIG. 9 mounted on a sail slide;

FIG. 11 shows the luff portion of a full-batten sail having one of my self-flaking sail shackles secured thereto to cause the batten to flake when the sail is lowered.

FIG. 12 is a cross-sectional view taken on line 12—12 of FIG. 11;

FIG. 13 is a plan view of a sail shackle blank for a full batten-sail prior to the blank having been folded into a U-shaped shackle configuration;

BRIEF DESCRIPTION OF PREFERRED EMBODIMENTS

Figure 1:
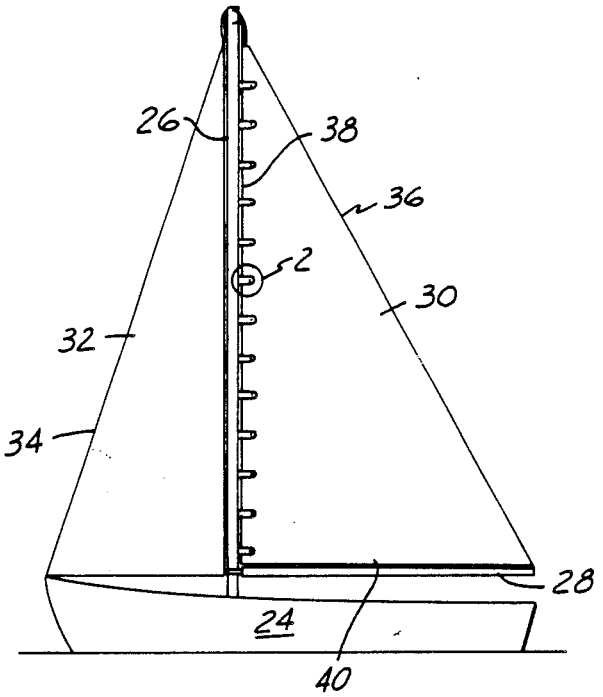
FIG. 1 is a side elevation of a sailboat having a mast, boom and sails embodying my invention.

In FIG. 1, I have shown a sailboat 24 having a mast 26, a boom 28, a mainsail 30 bent to the mast and boom, a jib 32 and a forestay 34 to which the jib is bent. The mainsail includes a leech 36, a luff 38 and a foot 40. While the invention is applicable to the jib 32 and its connection to the forestay 34, the invention is described in relation to the mainsail's attachment to mast 26.

Figure 2:
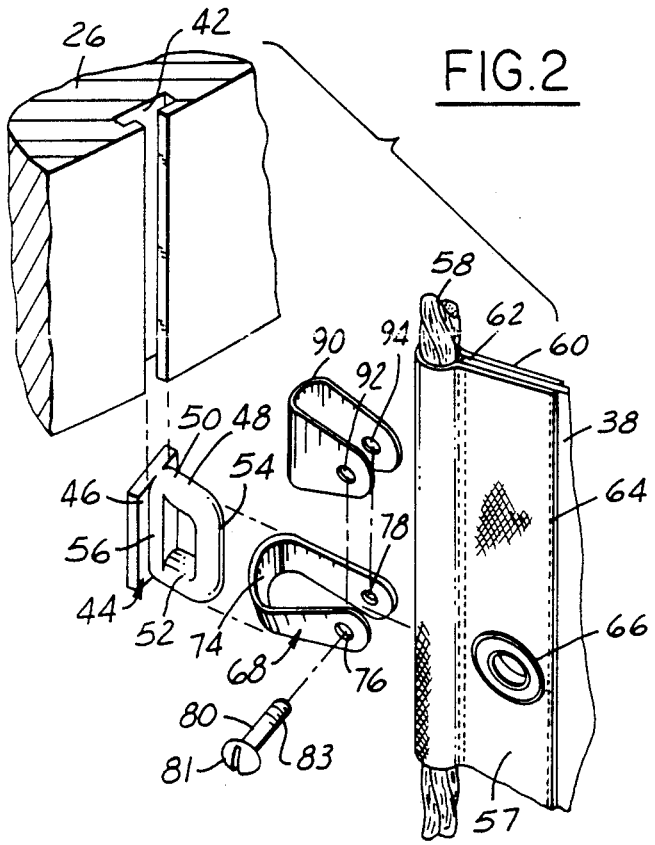
FIG. 2 is an exploded view from area 2 of FIG. 1 showing a portion of a mast and sail track, sail slide, shackle, anti-chafe member, and sail luff embodying my invention.

As shown in FIG. 2, a fragmentary portion of the mast 26 shows a conventional sail track 42 formed in the afteredge of the mast within which a conventional sail slide 44 may slide vertically up and down the mast. The sail slide has a base portion 46 and an upstanding, generally U-shaped bail portion 48 having a pair of legs 50, 52 connected by a bight portion 54. The legs 50, 52 are secured to the base 46 at an increased thickness area 56. The slide may be formed of plastic or metal or a combination thereof. In one embodiment of the invention, as shown in FIGS. 2—12, the sail slide is of conventional construction and readily available on the market. A series of these slides is introduced into the sail track 42 to serve as points of connection of the said luff to the mast.

Also as shown in FIG. 2, the mainsail includes a marginal luff portion 57 which, for purposes of illustration, includes a bolt rope 58 secured to the sail by a strip of fabric 60 which has been folded around the bolt rope and stitched through the sail as at 62, 64. A grommet 66 of conventional construction extends through the fabric 60 and the luff 38 and serves as a point of attachment of the luff to the sail slide 44.

Figure 3:
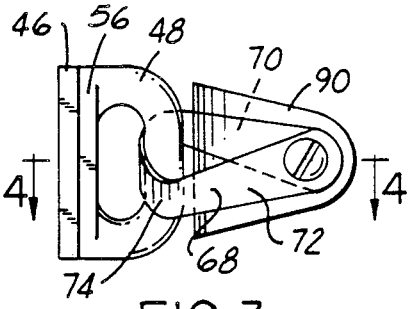
FIG. 3 is a side view of a sail shackle and sail slide embodying my invention.
Figure 4:
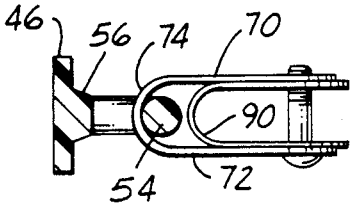
FIG. 4 is a cross-sectional view taken on the line 4—4 of FIG. 3.

Attachment of the luff to the sail slide is effected by the unique sail shackle 68 shown in FIGs. 2–4 and several other figures of the drawings. The shackle is of generally U-shaped configuration having a pair of legs 70 and 72 joined at one end by a bight portion 74 and having adjacent the free ends aligned apertures 76, 78 with aperture 78 being threaded for a retainer pin 80 to be received through the apertures. The pin is threaded as at 83 to be threadedly connected in aperture 78. The legs 70 and 72 of the shackle embrace the marginal luff area of the sail and the pin 80 is extendible through the grommet 66 with the pin head 81 overlying the free end of leg 72 to lock the sail shackle on the sail with the legs closely embracing the opposed surfaces of the luff. The sail shackle 68 has its aperture 76,78 lying in an imaginary plane which intersects the bight portion 74, with the bight portion crossing such plane at an angle of preferably approximately 52-½°. This angular relationship is perhaps best shown in FIGs. 20–22 where the sail shackle is illustrated in its blanked out form prior to being folded into its U-shaped configuration.

Figure 20:
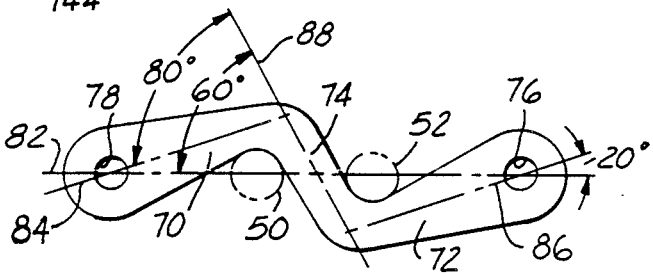

Considering FIG. 20, the shackle is shown in what may be referred to as a "lazy-z" configuration with the legs 70, 72 and the bight portion 74 being flat or coplanar. The apertures 76, 78 are also shown and for purposes of illustrating the relationship of the bail legs 50 and 52 such are shown in phantom outline. By folding the legs 70, 72 toward each other while maintaining the apertures 76, 78 in alignment, the apertures are in effect moved in a plane 82 such that on completion of the folding, the apertures will lie in transverse alignment in plane 82. The bight portion 74 of the shackle is formed in a curve as shown in FIGS. 2, 3, 4, 8 and 9. It will be noted from FIGS. 20–22 that the longitudinal axes 84, 86 of the legs are parallel before the shackle is formed up into its U-shaped configuration. The axis 88 of the bight portion is shown lying at an angle of 60° to the plane 82 in FIG. 20. Thus when the flat shackle is folded into its U-shaped configuration as shown in either FIGS. 8 or 9, the angle of incidence between the bight portion 74 and a plane coincident with the transverse apertures 76, 78 lies at 60°. Similarly, in FIG. 21 the angle between the bight portion 74' and the imaginary plane through the transverse apertures lies at 52-½° while in FIG. 22 the bight portion 74" lies at the angle of 45° to the imaginary plane coincident with the transverse apertures. My testing has indicated that the angle of incidence between the bight portion and a plane coincident with the transverse apertures may range from 30° to a maximum of about 80° . The preferable angle of incidence is 52-½°.

Figure 5:
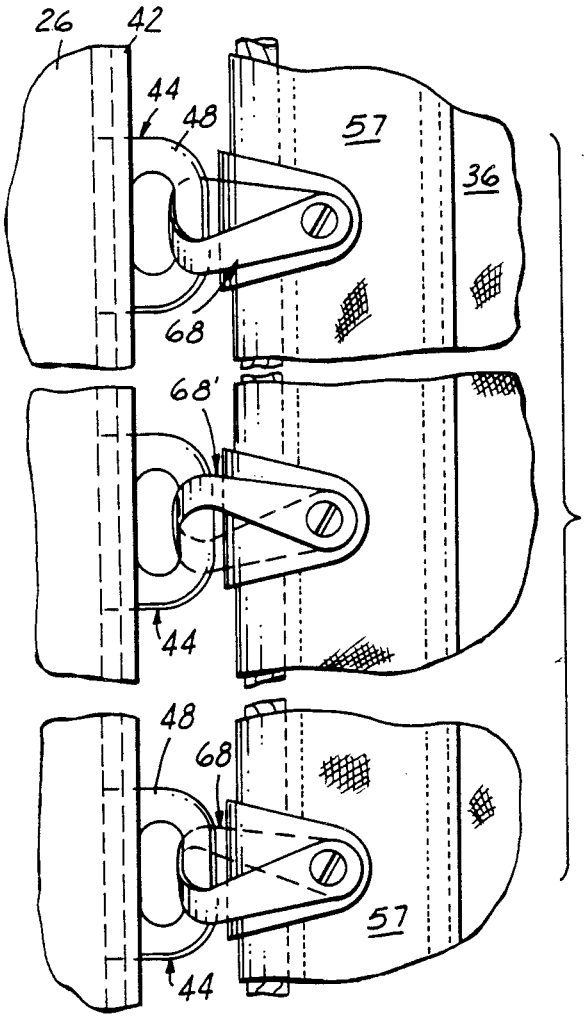
FIG. 5 shows three sail slides and connected shackles securing a sail luff to a sail track and illustrating the relationship of the parts when the sail is hoisted, and in normally-working relation with the sail track.
Figure 6:
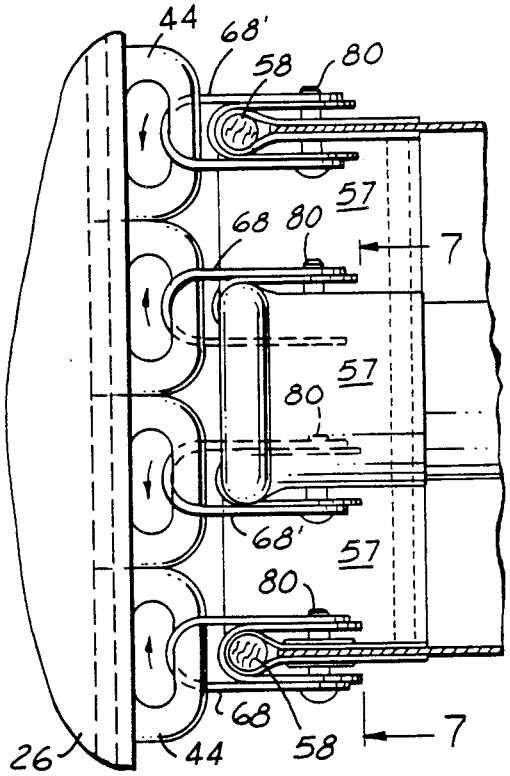
FIG. 6 is a view similar to FIG. 5 but with the sail lowered and flaked in accordance with the invention.
Figure 7:
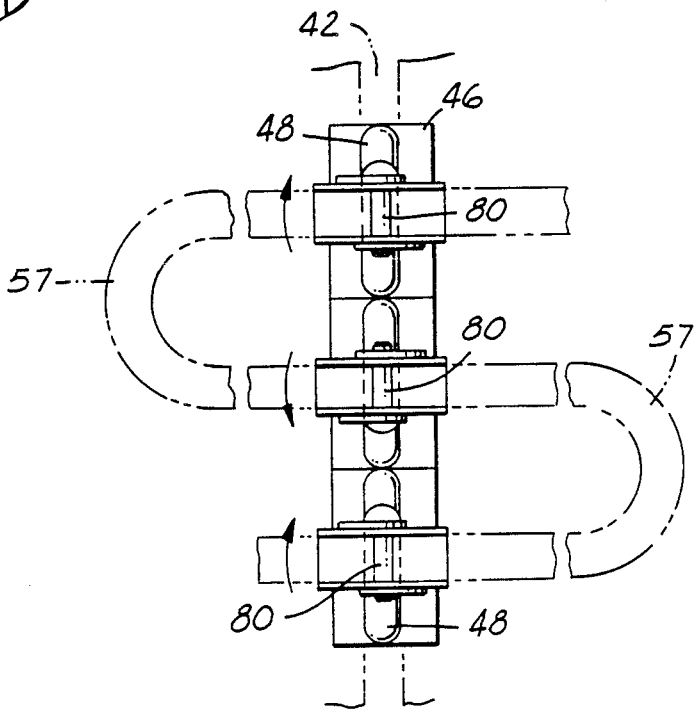
FIG. 7 is a cross-sectional view looking toward the sail track taken on the line of 7—7 of FIG. 6.
Figure 21:
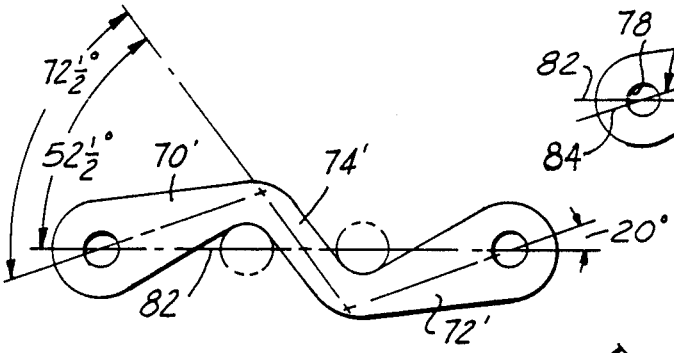
FIGS. 20–22 show three sail shackle blanks for different size shackles prior to bending into U-shaped configuration and illustrating important angular relationships.
Figure 22:
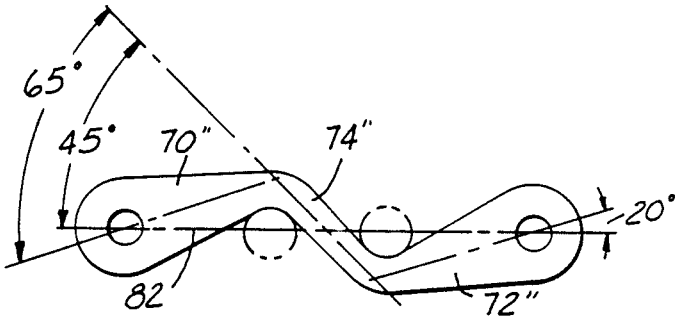

It will be noted that the way in which the sail shackle is folded, i.e., folded up or down as viewed in FIG. 20, will determine whether it will throw the sail luff one way or the other. For example, in FIGS. 2, 3 and 8 a right-hand shackle 68 is shown, which will throw the luff to the right as the sail is lowered, while in FIGS. 9 and 10 a left-hand shackle 68° is shown which will throw the luff to the left. FIGS. 5, 6, and 7 show that the right-hand and left-hand shackles are arranged successively along the luff to throw or flake the luff first one way and then the other as the sail is lowered. Looking, for example, at FIGS. 2 and 3, the shackle will prevent counterclockwise rotation and will throw the luff to the right when looking toward the sail track while the configuration shown in FIG. 10 will prevent clockwise rotation and throw the luff to the left. This is the result of the legs of the shackle having edges adapted to engage the bail 48 of the sail slide to limit rotation of the shackle on the bail between positions in which the pin 80 is either parallel to the bail as in FIG. 7 or perpendicular to the bail as in FIG. 5. In addition, the amount of twisting or flaking of the luff allowed by the shackle and bail is a function of the relative dimensions of the bail and the shackle legs. The angle of incidence between the shackle bight 74 and the imaginary plane 82 coincident with the transverse apertures 76 and 78 must be varied as the thickness of the bail legs and/or thickness of the shackle legs and shackle bight is varied. This is illustrated in FIGS. 20–22 where, for example, the legs 70, 72 are shown as being wider in FIG. 20 than in FIG. 22 and in FIG. 20 the angle of incidence is 60° while in FIG. 22, it is 45°.

As shown in FIGS. 2, 3, and 4, an anti-chafe element 90 may be inserted into the shackle with aligned transverse hole 92 and 94 receiving the pin 80 therethrough. The anti-chafe element prevents the luff from rubbing the legs of the shackle or the bail 48 of the slide. The anti-chafe element may be formed of plastic or any other suitable material.

In FIGS. 11–13, I have shown a shackle particularly suitable for use with a full batten sail. The shackle is conceptually the same as that previously described, except the legs 70*a*, 72*a* are wider than the corresponding legs 70, 72 of the previously described shackle. In addition, the legs are provided with aligned pairs of apertures, 96, 98, 100, 102 and the apertures 96, 98 may be threaded to receive therethrough the threaded end of pins 80' corresponding to that previously described.

In addition, the shackle includes a transverse thrust bar 104 comprising tabs 106, 108 integral with the legs 70*a*, 72*a* and which overlap one another when the shackle is folded to bring the apertures 96, 98, 100, 102 into transverse alignment as shown in FIGS. 11 and 12. The thrust bar prevents the shackle from moving toward the sail track carrying the luff against the bail 48. The bight portion 74*a* is inclined to an imaginary plane coincident with aligned apertures, 96, 98, 100, 102, similar to the inclination of the bight portion in the previously-described shackle. The full-batten sail with which the shackle of FIGS. 11, 12, and 13 is useable is provided with a batten pocket 110 which is stitched across the sail from luff to leech and receives a batten 112 therein. The pins 80' extend through suitable apertures in the batten. In this arrangement, when the sail is dropped, the self-flaking shackles will cause successive battens to flake first to the right and then to the left thus flaking the sail across its width from luff to leech.

Figure 14:
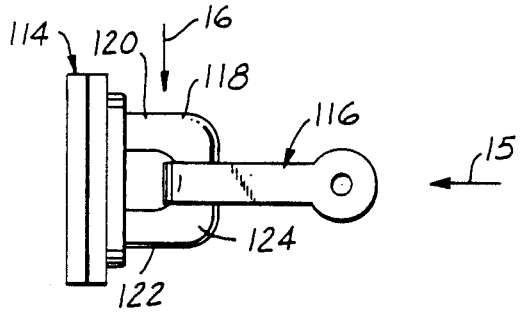
FIG. 14 is a side view of a sail slide having an inclined bail for causing a sail luff to flake in a controlled direction.
Figure 15:
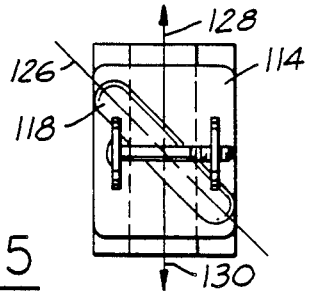
FIG. 15 is an end view looking in the direction of Arrow 15 of FIG. 14 showing the inclined relation of the sail slide bail in relation to the sail shackle.
Figure 16:
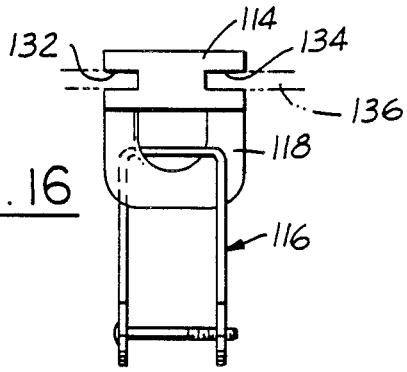
FIG. 16 is a top view of the device shown in FIG. 14 looking in the direction of Arrow 16 of FIG. 14.

In FIGS. 14–19 inclusive, I have shown a modification of the invention in which a conventional sail shackle is used in combination with a modified form of sail slide. The principal of operation is similar to that for the shackle previously described. In this embodiment, the sail slide 114 cooperates with a conventional U-shaped sail shackle 116. The slide is introduced in a suitable track, such as the track 42 previously described and the shackle 116 is secured to the luff of the sail similar to that heretofore described. The bail 118 in the embodiment of FIGS. 14, 15, and 16 is U-shaped with a pair of parallel legs 120, 122 connected by a bight portion 124. The bail lies in an imaginary plane 126 best shown in FIG. 15 which is inclined at an angle to the direction of movement of the slide represented by the arrows 128 and 130. This angle, similar to the angle previously discussed in connection with the first embodiment of the invention may be anywhere from 30 degrees to 80 degrees. Preferably, the angle is 45°. As shown FIG. 15, the shackle will be prevented from clockwise rotation, but will be permitted counter-clockwise rotation. Thus, this shackle may be referred to as a left-hand shackle as it will throw the luff to the left as a sail is lowered. Right-hand slides may be similarly provided so that successive slides may be right-hand and left-hand. As shown in FIG. 16, the slide may be provided with oppositely-disposed, outwardly-opening, mast-receiving grooves 132, 134 for embracing the marginal edges of a mast 136 at the sail track.

Figure 17:
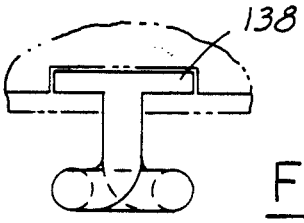
FIG. 17 is a modified form of the sail slide looking in the direction of Arrow 17 in FIG. 18.
Figure 18:
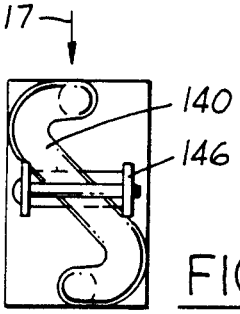
FIG. 18 is a view of the modified form of the sail slide of FIG. 17 looking at the slide in plan view and showing a sail shackle associated therewith.
Figure 19:
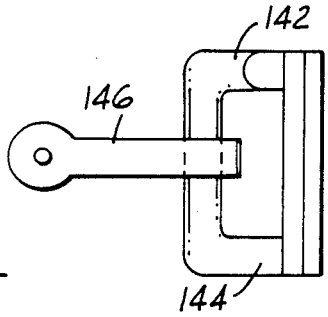
FIG. 19 is a side view of the sail slide and shackle shown in FIG. 18.

In FIG. 17–19, I have shown as slightly modified form of the sail slide which is suitable for use in a track of the type shown in FIG. 2. In this case, the slide has a base portion 138 to be disposed within the track, similar to the track 42, and the base portion extends through the track slot similar to the bail of the slide 44. The bail, however, is of S-shaped configuration in plan view as best shown in FIG 18 to provide an inclined bight portion 140 connecting substantially parallel leg portion 142 and 144. The inclination of the bight portion 140 to the line of movement of the slide up and down the mast is, as previously, described, preferably 52-½° though it may vary to a greater or smaller angle depending upon the particular mast configuration and the like. A conventional shackle 146 is looped through the bail and connected to a sail luff. As shown in FIG. 18, the slide will prevent clockwise rotation of the shackle but will permit counterclockwise movement thereby allowing the luff to flake to the left. As in the embodiment of FIGS. 14–16, successive slides may be provided with alternately angled bail bights and accordingly, a sail caused to flake first to the left and then to the right as it is lowered.

From the foregoing description, it is apparent that I have provided a series of pair of interconnected sail slide and shackles which are spaced apart along the luff of a sail and the associated sail track, with the slides engaged with the track and the shackles engaged with the luff of the sail. Each shackle and slide of each pair has a generally U-shaped portion with such portions looped together to connect the slides and shackles. Such looped-together portions have contacting edge surfaces and so angled with respect to each other that relative rotation between the angle and slide is limited to substantially 90°, i.e., between a position in which the sail luff adjacent each of said pairs is parallel to the track as shown in FIG. 5 and a position in which the luff is perpendicular to the track as shown in FIG. 7. The permitted rotation is alternatively in opposite directions for successive pairs of shackles and slides and best shown in FIG. 7.

The slides and shackles above-described can be made of metal or plastic or any material that retains its shape and strength at sailing temperatures and can be round or flat and cast or molded so long as the shape described above is maintained.

What is claimed is:

1. A system for causing controlled flaking of a sail as it is lowered comprising, in combination:

a sail track for arrangement in a generally vertical plane;

a sail having a luff for attachment to said track; and a series of pairs of looped-together sail slides and sail shackles to connect the sail luff at spaced-apart points therealong to said track for sliding movement along the track and rotation between positions either parallel or perpendicular to the track;

said sail slides and sail shackles having rotation limiting portions at each of said spaced points arranged to prevent rotation in first one direction and then the other at said successive spaced points, whereby on lowering the sail, the luff is caused to flake first one way and then the other along the track.

2. The invention defined by claim 1 wherein each of said sail slides has an upstanding bail comprising a pair of legs and connected by a bight portion and each of said sail shackles comprises a pair of legs connected at one end by a bight portion and is looped through the bail, and said rotation limiting portions comprise the legs of said bails and shackles.

3. A device for connecting a sail luff to a sail track and causing the luff to flake in a predetermined direction as it is lowered comprising, in combination:

a sail slide and companion sail shackle having looped together generally U-shaped portions;

at least one U-shaped portion, when the slide and shackle are in operative position, lying at an angle to the direction of sail slide movement during sail raising and lowering; and said U-shaped portions being dimensionally sized in relation to the angle of the inclined plane to permit limited rotation between the slide and shackle from a position in which a sail luff connected to the shackle is parallel to sail slide movement and a position substantially perpendicular to said sail slide movement.

4. The invention defined by claim 3 wherein said at least one U-shaped portion is the U-shaped portion of the shackle.

5. The invention defined by claim 3 wherein said at least one U-shaped portion is the U-shaped portion of the sail slide.

6. The invention defined by claim 4 or claim 5 wherein the angle is substantially 52-½° .

7. The invention defined by claim 4 or claim 5 wherein the angle lies between 30° and 80° .

8. A self-flaking attachment for connecting the luff of a sail to a track and permitting the luff to straighten when the sail is stretched along the track and causing the luff to flake alternately when the luff collapses along the track comprising, in combination:

a series of pairs of interconnected sail slides and shackles spaced apart along the luff and track with the slide engaged with the track and the shackle engaged with the luff;

each shackle and slide of each pair having a generally U-shaped portion with such portions looped together to connect the slide and shackle;

said looped-together portions having contacting edge surfaces and being so angled with respect to each other that relative rotation between said shackle and slide is limited to substantially 90° between a position in which the sail luff adjacent each of said pairs is parallel to the track and a position in which the luff is perpendicular to the track; and said contacting edge surfaces and said looped-together portions being so arranged that rotation is permitted alternately in opposite directions for successive pairs of shackles and slides.

9. A system for causing controlled flaking of a full-batten sail as it is lowered comprising, in combination:

a sail track arranged in a generally vertically plane;

a sail having a luff and a leech with a series of battens extending substantially from the luff to the leech and spaced apart vertically therealong;

means for connecting the luff end of each batten to said track for sliding movement along said track and rotation of the batten between positions either parallel or perpendicular to the direction of sliding movement along the track; and said means having rotation limiting portions at each batten arranged to prevent rotation in first one direction and then the other at successive battens, whereby on lowering the sail the successive battens are flaked first in one direction and then the other as the sail collapses.

10. The invention defined by claim 9 wherein said means comprises a series of pairs of looped-together sail slides and sail shackles with a shackle connected to the luff end of each batten and wherein said sail slide has an upstanding bail comprising a pair of legs connected by a bight portion and said sail shackle is looped through the bail and said rotation-limiting portions comprise the legs of said bail and shackle.

11. The invention defined by claim 10 wherein said shackle is provided with a transverse portion extending between the legs of the shackle spaced from the bight portion thereof and adapted to abut the bail of the sail slide to limit movement of the shackle toward the slide.

12. A self-flaking sail shackle comprising a generally U-shaped member having a pair of laterally spaced-apart leg portions integrally connected at one end by a bight portion and having adjacent the opposite ends transversely aligned retainer-receiving apertures;

a retainer pin extending through and locked in said apertures;

a U-shaped chafe-preventing member disposed within the shackle and having a pair of legs connected together at one end by a bight portion and having at the opposite end a pair of aligned apertures with said pin extending through the apertures of the chafe-preventing member and with the bight portion of the chafe-preventing member spaced from the bight portion of the shackle;

the apertures of said shackle lying in a plane intersecting the bight portion of the shackle at an angle lying between and including approximately 30° and 80°; and the bight portion and legs of the shackle having edges adapted to engage the bail of a sail slide through which the shackle is looped to limit rotation of the shackle on such bail between positions in which said pin is either perpendicular to the bail or parallel thereto.

13. A self-flaking sail slide comprising a base member for sliding engagement with a sail track;

a generally U-shaped bail fixed to and upstanding from the base member;

said bail lying in a plane disposed perpendicular to the base member and inclined to the direction of slide movement during raising and lowering of a sail, said angle of inclination lying between approximately 30° and 80°; and said bail adapted to cooperate with a sail shackle looped therethrough to limit rotation of the shackle to approximately 90°.

* * * * *

UNITED STATES PATENT AND TRADEMARK OFFICE

CERTIFICATE OF CORRECTION

PATENT NO. : 4,986,205

DATED : January 22, 1991

INVENTOR(S) : John E. Somers

It is certified that error appears in the above-identified patent and that said Letters Patent is hereby corrected as shown below:

On the title page, add --[73] Assignee: Marjorie J. Sommers--;

Column 2, lines 60 and 61
After "shown" delete the paragraph and continue with "in";

Column 3, line 6
"FIGs." should be --FIGS.--;

Column 3, line 23
"FIGs." should be --FIGS.--;

Column 4, line 58
after "The" and before "of", "principal" should be --principle--;

Column 5, line 16
after "shown" and before "slightly", "as" should be --a--;

Column 5, line 40
after "of" and before "of interconnected", "pair" should be --pairs--; and

UNITED STATES PATENT AND TRADEMARK OFFICE

CERTIFICATE OF CORRECTION

PATENT NO. : 4,986,205

DATED : January 22, 1991

INVENTOR(S) : John E. Sommers

It is certified that error appears in the above-identified patent and that said Letters Patent is hereby corrected as shown below:

Column 5, line 41
after "sail" and before "and shackles", "slide" should be --slides--.

Signed and Sealed this

Twenty-first Day of April, 1992

*Attest:*

HARRY F. MANBECK, JR.

*Attesting Officer*

*Commissioner of Patents and Trademarks*